US009724747B2

(12) United States Patent
Anderson et al.

(10) Patent No.: US 9,724,747 B2
(45) Date of Patent: Aug. 8, 2017

(54) WIRE SHAPING SYSTEM AND METHOD FOR HAND TOOL USE

(71) Applicants: Wayne Anderson, Northport, NY (US); Warren Anderson, Northport, NY (US)

(72) Inventors: Wayne Anderson, Northport, NY (US); Warren Anderson, Northport, NY (US)

( * ) Notice: Subject to any disclaimer, the term of this patent is extended or adjusted under 35 U.S.C. 154(b) by 522 days.

(21) Appl. No.: 13/844,961

(22) Filed: Mar. 16, 2013

(65) Prior Publication Data

US 2013/0240078 A1 Sep. 19, 2013

Related U.S. Application Data

(60) Provisional application No. 61/612,577, filed on Mar. 19, 2012, provisional application No. 61/612,600, filed on Mar. 19, 2012.

(51) Int. Cl.
*B21F 1/00* (2006.01)
*B25F 1/02* (2006.01)
*H01R 43/28* (2006.01)

(52) U.S. Cl.
CPC ..... *B21F 1/002* (2013.01); *B25F 1/02* (2013.01); *H01R 43/28* (2013.01)

(58) Field of Classification Search
CPC .... B21F 1/00; B21F 1/002; B21F 1/06; B25F 1/02; H01R 43/28
USPC ..... 140/123, 149; 7/107, 108
See application file for complete search history.

(56) References Cited

U.S. PATENT DOCUMENTS 2,440,058 A * 4/1948 Mitchell ..... B21F 7/00 140/149
2,824,475 A * 2/1958 Rolando ..... B21F 1/06 140/123
3,244,202 A * 4/1966 Huang ..... H01R 43/033 242/439.1
4,060,305 A * 11/1977 Poliak ..... H01R 4/34 7/107

(Continued)

FOREIGN PATENT DOCUMENTS

CN 1294957 5/2001
CN 1827310 9/2006

(Continued)

OTHER PUBLICATIONS

CN 201310112414.9, Office Action issued Aug. 31, 2015, 13 pages—English.

(Continued)

*Primary Examiner* — Teresa M Ekiert
(74) *Attorney, Agent, or Firm* — Andrew F. Young, Esq.; Lackenbach Siegel, LLP

(57) ABSTRACT

The present invention relates to wire bending system for a hand tool for forming a controlled bend in a wire. The tool has a wire bending system engaged with a hand tool. The wire bending or shaping system may be open or enclosed, and optionally permits bending in a direction that is perpendicular or coaxial to an axis of a hand tool. The wire bending system may be at either side of the hand tool. A pin may be used to additionally aid bending. The hand tool is provided with a plurality of first and second operably engaged housings for securing a number of tool bits members.

10 Claims, 11 Drawing Sheets

(56) References Cited

U.S. PATENT DOCUMENTS

| | | | | | |
|---|---|---|---|---|---|
| 4,074,732 | A * | 2/1978 | Wilkens | H01R 43/033 | 140/123 |
| 4,111,242 | A * | 9/1978 | Jacobson | H01R 43/033 | 140/124 |
| 4,257,159 | A * | 3/1981 | Wingert | H01R 43/00 | 7/108 |
| 4,423,757 | A * | 1/1984 | Broberg, Jr. | B21F 1/002 | 140/123 |
| 5,309,954 | A | 5/1994 | Franssen | | |
| 6,293,173 | B1 | 9/2001 | Rowley | | |
| 6,298,756 | B1 | 10/2001 | Anderson | | |
| 2010/0269263 | A1* | 10/2010 | Burch | B25B 15/02 | 7/108 |

FOREIGN PATENT DOCUMENTS

| | | |
|---|---|---|
| CN | 2880395 | 3/2007 |
| CN | 201175888 | 1/2009 |
| CN | 201537890 | 8/2010 |

OTHER PUBLICATIONS

CN 201310112414.9, Search Report issued Aug. 17, 2015, 3 pages—English.
CN 201310112414.9, Office Action issued Jul. 1, 2016, 9 pages—English.
CN 201310112414.9, Search Report dated Jun. 13, 2016, 2 pages—English.
CN 201310112414.9, Office Action issued Feb. 13, 2017 8 pages—English.

* cited by examiner

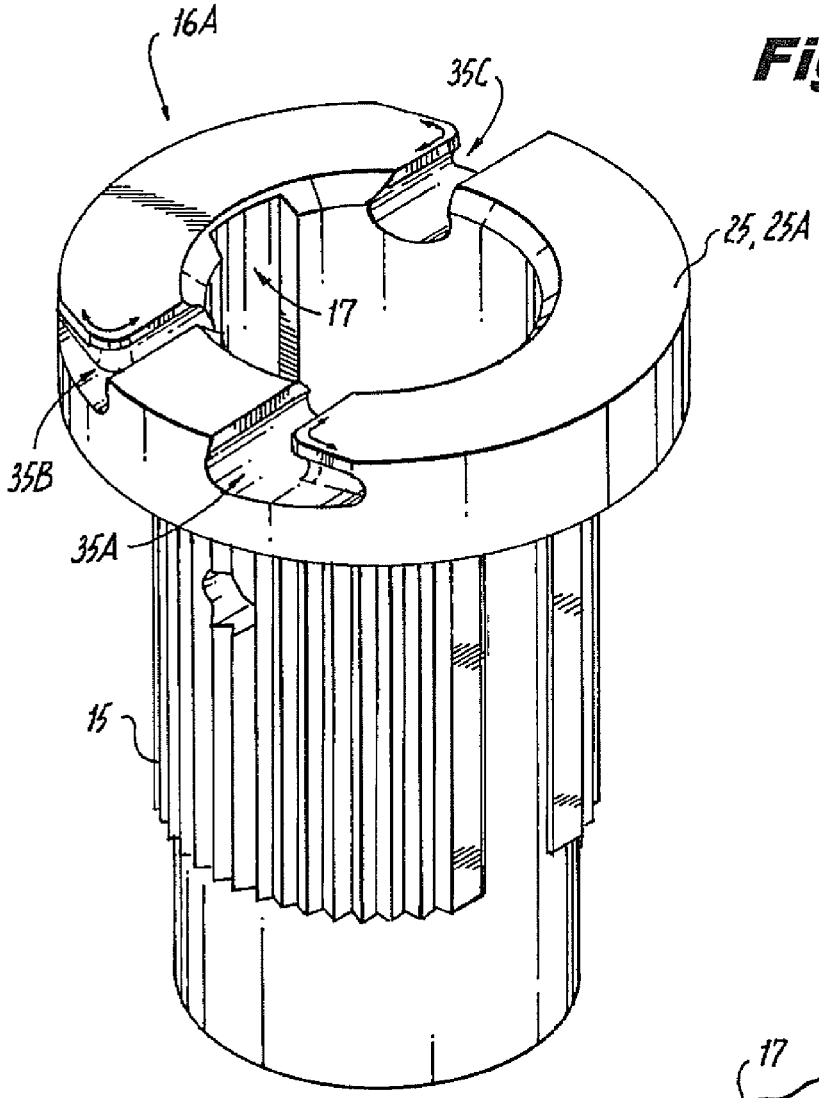
Fig. 3
Fig. 4
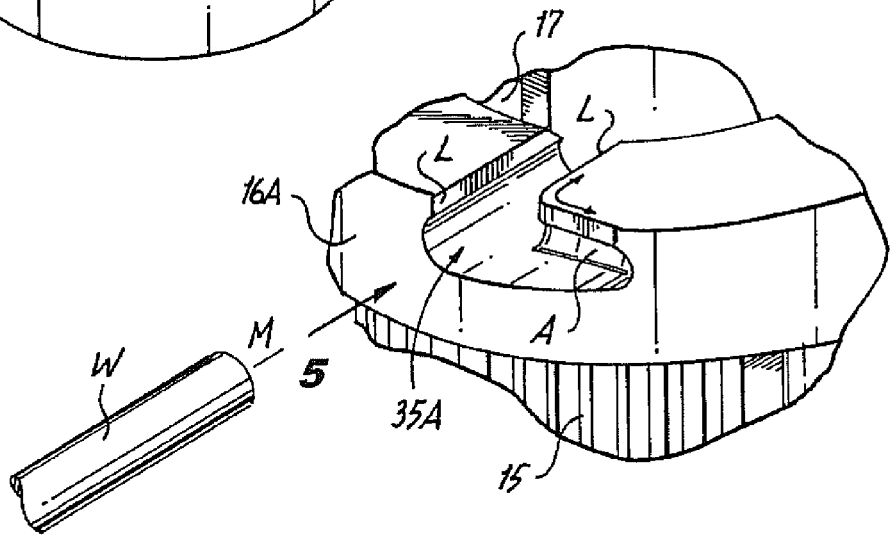

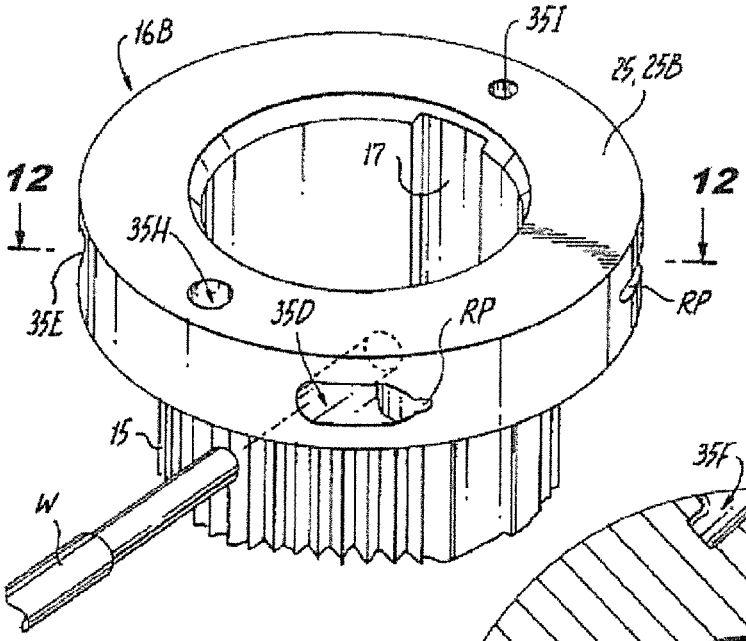
Fig. 11
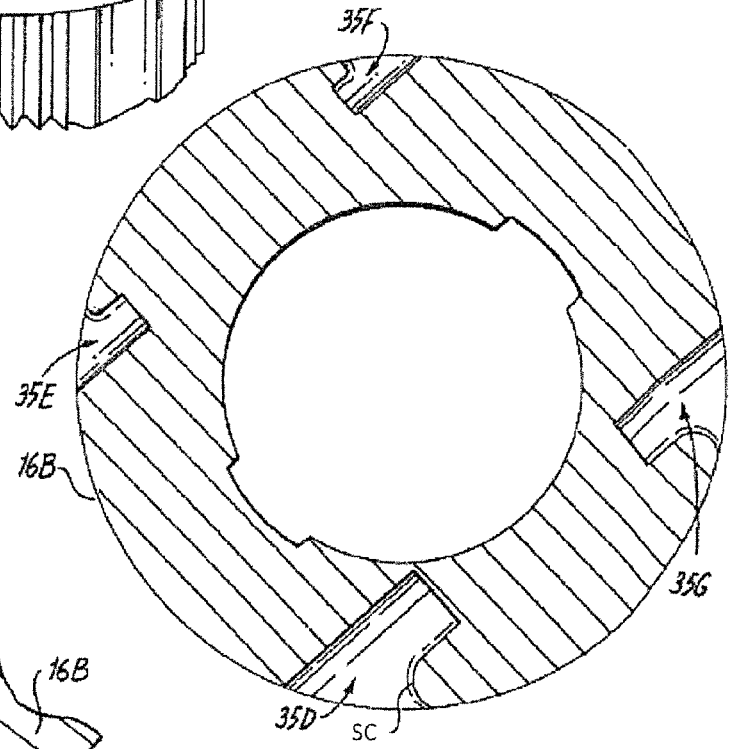
Fig. 12
Fig. 13
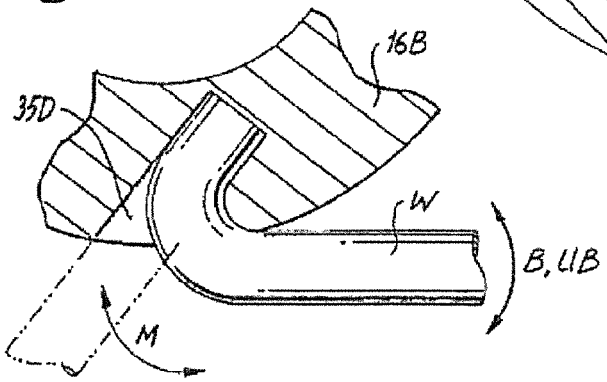

Fig. 14A
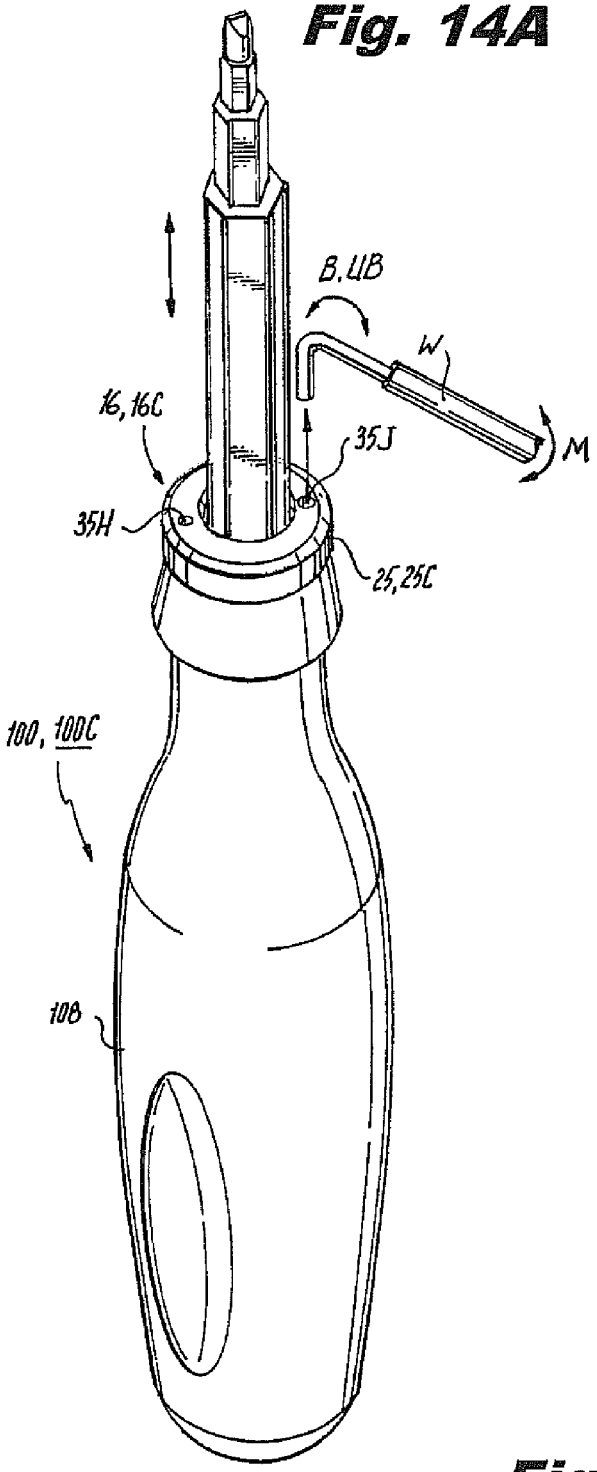
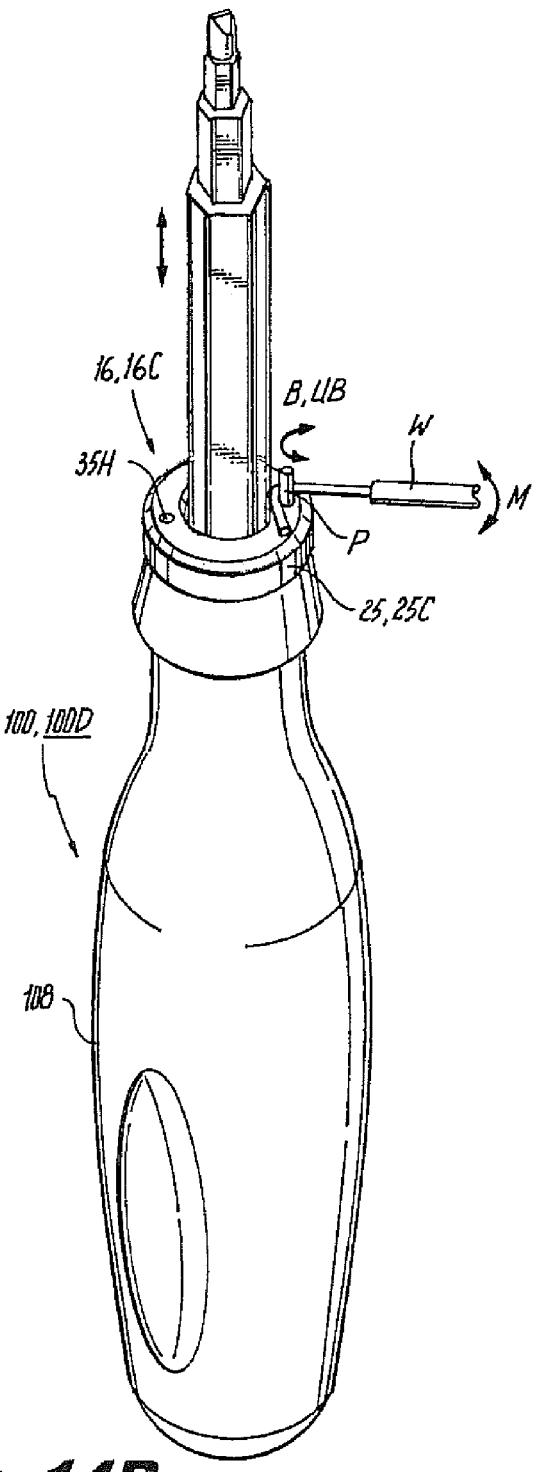
Fig. 14B

Fig. 21
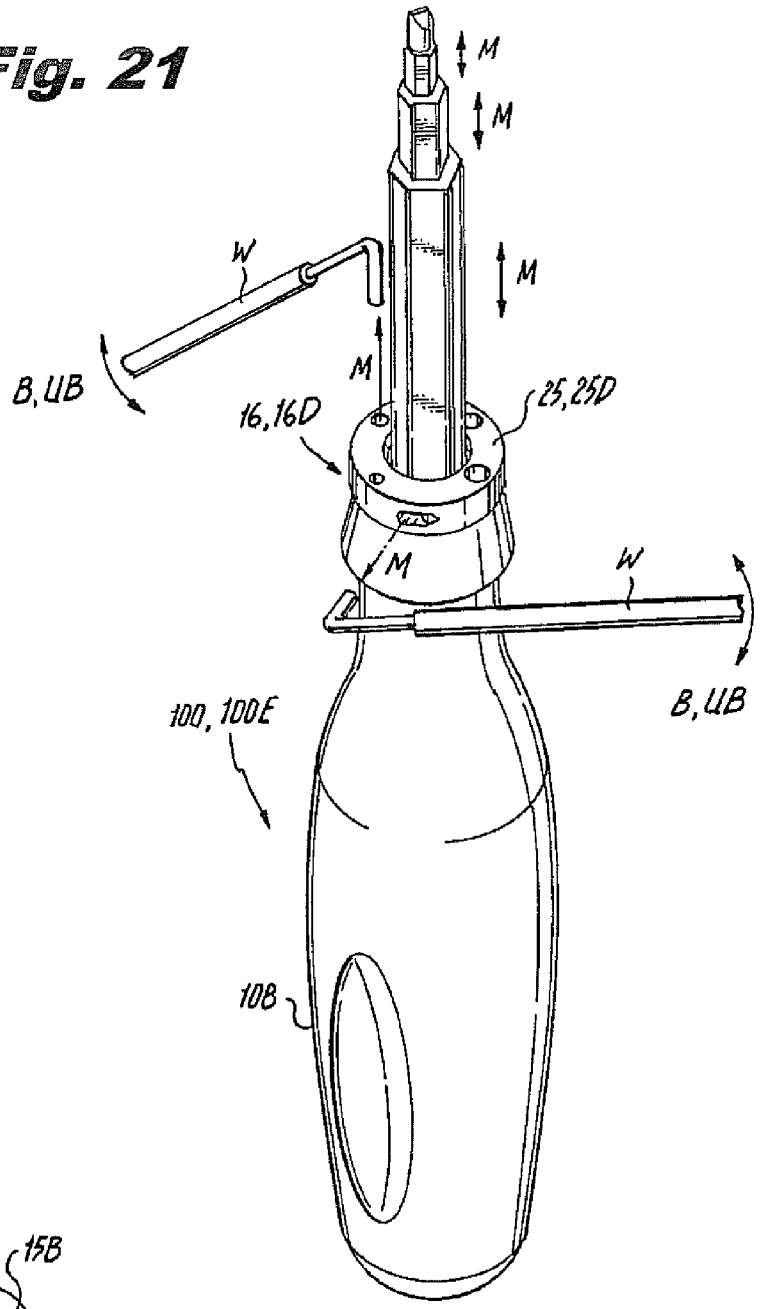
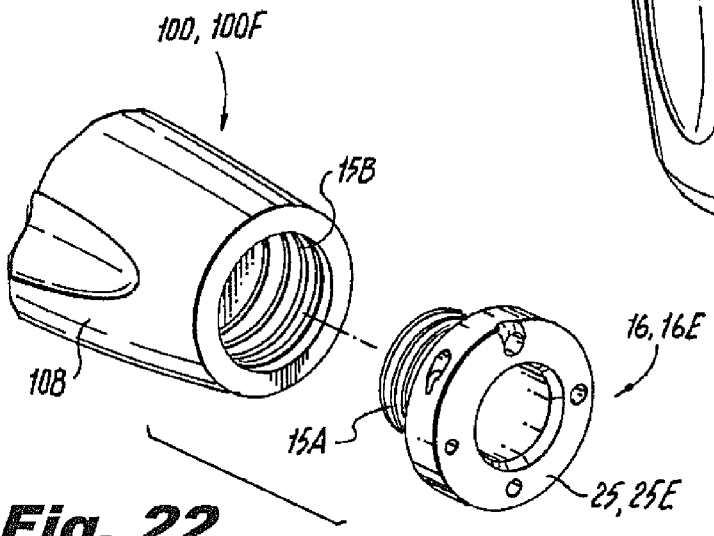
Fig. 22

WIRE SHAPING SYSTEM AND METHOD FOR HAND TOOL USE

CROSS REFERENCE TO RELATED APPLICATIONS

This application relates to and claims priority from U.S. Prov. Ser. No. 61/612,577 filed Mar. 19, 2012 and U.S. Prov. Ser. No. 61/612,600 filed Mar. 19, 2012, the entire contents of each of which are fully incorporated herein by reference.

BACKGROUND OF THE INVENTION

Field of the Invention

This invention relates to an electrical installer hand tool. More particularly, the present invention relates to an electrical installer hand tool involving a wire shaping system.

Description of the Related Art

Electrical wires are typically cylindrical in shape, are of indeterminate length, and are encased within an insulating sheath that must be removed before installation. The electrical wire may be a single strand, or may be a plurality of strands twisted in helical fashion to form an approximately cylindrical configuration. These wires are of various diameters, materials, and stiffness. In use, a portion of the insulation, at an end of the wire, is removed, and the bare wire is then formed into a controlled bend of a desired dimension. The controlled bend has an arcuate portion or bight with a relatively straight portion or leg at the end. It is often, but not always, desirable that the legs be parallel, or approximately parallel to a main wire body, for ease of assembly to a contact or terminal connection. It will be understood, that non-parallel bending is also suitable depending upon the particular installation geometry, such that it is sufficient to note the wire must be bent with an arcuate angle to engage a screw. Typically, the contact is a screw having a threaded shaft and a shaped head of substantially larger diameter than the shaft (the shaped head having a geometry for driving (slot, Phillips, square, star drive etc.), the controlled bend being placed so that the two legs straddle the threaded shaft of the screw, and are beneath the head of the screw for electrical connection. After positioning the controlled bend of the wire in this manner, the screw is tightened, so that the underside of the head of the screw engages the electrical wire controlled bend and presses it against another part of the contact structure.

Pliers are typically used to form the controlled bend in an electrical wire with the electrical installer grasping one end portion of a generally straight wire, without insulation on the end portion, and bending the wire to form a controlled bend. Care and skill are required to form the controlled bend in the wire so that the legs are in the desired relation to each other. If the leg at the free end of the wire is not bent far enough, that is, is bent through significantly less than 180 degrees, an open V-shaped bend will result, which provides a structure that might be too large to be positioned in the terminal structure, due to parts providing a limited space for the bent wire.

When this occurs, time is consumed in rebending or unbending the wire with the intent of making the two legs substantially parallel and aligned, but care must be taken to avoid bending the leg forming the free end of the wire too much for, in that event, the leg forming the free end of the wire will substantially close the opening which is used for the straddling of the screw shank by the two legs of the bent wire. Also, if too much force is initially applied to the wires, a closed loop will be formed, prohibiting manipulation of the wire so as to straddle the screw shank in a tight confinement geometry. Electrical installers have used conventional long-nose pliers to form such controlled bends. Round nose pliers have permitted formation of more circular loops, but, because of their tapered jaws, they do not ensure that repeated use will result in identically sized or shaped loops. However, this results in imperfect loops and imperfect connections.

Other specialty pliers are known for bending wires or forming them into loops, commonly known as wire wrapping pliers, which have one jaw formed in a series of stepped diameter cylinders, and the other jaw being flat or concave where it faces the cylindrical jaw. Such wire wrapping pliers are not convenient to forming tight loops because the wire was gripped between the jaws at a location which was typically 180 degrees away from the closure of the loop. Forming the loop adjacent the contact between the jaws of such pliers exposes the wire to the edge of the flat or concave jaw, reintroducing the possibility of undesired deformation of the wire resulting from contact with such edge.

Other wire bending tools include a terminal connector having a disc with a hole through which the shank of a terminal screw is inserted. The disc has a pair of upstanding flanges that are spaced apart. The wire is passed adjacent to the shank of the screw and between the spaced flanges. A screwdriver is then used to rotate the screw to bend the wire around the screw shank. The wire is then placed on a screw forming part of the wire terminal.

These known tools all have the same or similar deficiencies. That is, these tools are not able to form controlled bends in a consistent and conventional manner, and cannot provide a controlled bend in which the legs are substantially parallel, and are not adaptable to deal with the various gauges (thicknesses) of wire. Conventionally, with all of these tools, great care is required by the electrical installer in order to achieve the formation of a bend of optimum configuration for placing on the threaded shank of a terminal screw. Moreover, some of these devices are combined terminal and tool device, and are not a separate, readily usable workman's tool for making controlled bends in wires in preparation for placement of the wires on electrical terminal screws separate from the tool. These conventional tools also prohibit adaption to tight confinement working places (e.g., in a breaker box, etc.), and do not adapt to various wire-bending orientations.

The present invention overcomes at least one of the proposed shortcomings of the prior art by providing a wire shaping, bending or forming device that may be used in conjunction with any number of tools that may be used by electricians and that is easy and convenient to use in order to form precise and consistently-sized wire bends or loops depending on the gauge or size of the wire.

ASPECTS AND SUMMARY OF THE INVENTION

The present invention relates to wire bending system for a hand tool for forming a controlled bend in a wire. The tool has a wire bending head at one end of a shaft capable of being inserted into a tool handle. The wire bending head preferably includes at least one wire bending member for allowing either a radial bending (projecting away from the hand tool) or a coaxial bending (projecting along the line of the hand tool)

The present invention also optionally relates to a tool for forming a controlled bend in a wire in a ready and facile manner. The invention also provides a single hand tool, such as a hand driving tool, that provides the electrical installer with the requisite driving, wire cutting, stripping and bending configurations, thereby eliminating the need for an electrical installer to carry multiple hand tools.

The hand tool, in one alternative aspect, provides a wire sizing, stripping, driving and shaping device specially configured for electrical installer operations. The hand tool has, in one embodiment, in addition to a handle, a wire bending insert having a plurality of bending configurations, multiple unitary one-piece housing sleeves, including one master sleeve with oppositely disposed hexagonal ends and cavities which are sized to receive respective inner sleeves. This hand tool with the sizing and bending insert device provides the electrical installer with essentially all of the requisite functions for properly installing or connecting an electrical wire.

It is therefore an aspect of the present invention to provide a wire bending system for use with a hand tool which will readily form a controlled bend in a wire.

Another aspect of the present invention is to provide a wire bending tool in which a tool having a handle, a shaft and bending device may receive a wire and bend it, and un-bend it, to any desired extent and at a predetermined optimal radius depending on the gauge of the wire.

Still another aspect of the present invention is to provide a tool for forming bends in a wire in which a controlled bend to substantially 90 degrees (or any other specifically desire degree of bend from about 0 degrees (very slight bend) to about 180 degrees (full bend)) may be formed in wires of various sizes and of differing stiffness, and a further aspect of the present invention is to provide such a tool which is readily used, permits ready association of a wire with the tool, convenient and ready bending and unbending of the wire, and ease of removal of the wire with a controlled bend formed in it from the tool.

It is another aspect of the present invention providing a wire shaping system that allows wires to be bent and un-bent in a direction that is optionally tangential to an axial direction of the hand tool and that is optionally co-axial to the axial direction of the hand tool. This aspect allows a wire bending system that allows for use of strong and weaker user-wrist motions to bend differing wire gauges.

It is another aspect of the present invention to provide a wire shaping system that allows for a wire bending that minimizes or resists sharp-bends or crimping and wire-damage of a wire-being-bent, and supports the formation of a desired bend-radius for a wire shape preferred by a specific wire gauge.

It is another aspect of the present invention to provide a wire shaping system for a hand tool, comprising, a wire shaping member operably secured to the hand tool, the wire shaping member including at least one bending profile on an outer portion thereof for user access, the bending profile being at least one of a closed bending profile and an open bending profile, a handle defining a hand tool axis, first tool bit members, each first member being formed with oppositely disposed tool bit ends, second tool bit members, each second member being formed with oppositely disposed tool bit ends, and a shank, the shank having a proximate end and a distal end, the shank comprising means for removably, non-rotatably, holding the shank proximate end in the handle, the shank comprises a unitary one-piece first housing having oppositely disposed open ends and two unitary one-piece second housings having oppositely disposed open ends, each of the second housings being slidably non-rotatably received in the respective opposite ends of the first housing, the first tool bit member being slidably disposed in one second housing end, and the second tool bit member being slidably disposed in the other second housing end, whereby each tool bit is alternatively operably disposed in the distal end of the shank.

It is another aspect of the present invention to provide a wire shaping system for a hand tool, wherein: each end of each first member is formed with a rethread bit, and each end of each second member is formed with a drive bit.

It is another aspect of the present invention to provide a wire shaping system for a hand tool, wherein: each the drive bit corresponds in size to one the rethread bit so that in rethreading a hole the correspondingly sized drive bit is alternatively operably disposed in the shank to drive a correspondingly sized screw in the rethreaded hole.

It is another aspect of the present invention to provide a wire shaping system for a hand tool, wherein: at least one the first housing open end being formed with a first nut drive and at least one the second housing open end being formed with a second differently sized nut drive.

It is another aspect of the present invention to provide a wire shaping system for a hand tool, comprising: a wire shaping member operably secured to a handle of the hand tool, the wire shaping member including at least one bending profile on an outer portion thereof for user axis, the bending profile being at least one of a closed bending profile and an open bending profile, a first set of integral double-ended tool bit members, a second set of integral double-ended tool bit members, and a shank, the shank further comprising: a proximate end disposed in the handle and a distal end, and holding means for removably holding the first set of integral double-ended tool bit members and the second set of integral double-ended tool bit members, the holding means further comprising: a unitary, one-piece, first cylindrical housing having oppositely disposed ends, a second unitary one-piece cylindrical housing having oppositely disposed ends for removably holding the first integral double-ended tool bit members, the second unitary one-piece cylindrical housing being slidably received in one of the oppositely disposed ends of the first cylindrical housing, the first integral double-ended tool bit members being slidably received in the second housing ends, and a third unitary one-piece cylindrical housing having oppositely disposed ends for removably holding the second integral double-ended tool bit members, the third cylindrical housing being slidably received in the other end of the first cylindrical housing, the second integral double-ended tool bit members being slidably received in the third cylindrical housing ends, wherein one tool bit member is operably disposed in the distal end of the shank.

It is another aspect of the present invention to provide a wire shaping system for a hand tool, wherein: the first integral double-ended tool bit members having oppositely disposed first bits.

It is another aspect of the present invention to provide a wire shaping system for a hand tool, wherein: the second integral double-ended tool bit members each having oppositely disposed drive bits.

It is another aspect of the present invention to provide a wire shaping system for a hand tool, the wire shaping system operable for bending a wire during a use, the system comprising: a handle on the hand tool defining a hand tool axis, the wire shaping system proximate the handle, the wire shaping system including at least one bending profile on an outer portion thereof for user access, the bending profile being a closed bending profile for engaging an end of a wire for bending, the bending profile having an abutment operable for engagement of the wire along one of a plane transverse to the hand tool axis and a plane parallel to the hand tool axis, means for securing first leg portion of a wire into an engagement with the bending profile upon a rotation of the bending profile relative to the hand tool axis thereby forming a bend in the wire about the abutment, the bend being between the first leg and a second leg portion of the wire, and stop means spaced from the abutment for engaging the second leg portion of the wire after a predetermined amount of rotation of the bending profile relative to the hand tool axis.

It is another aspect of the present invention to provide a wire shaping system for a hand tool, wherein: the closed bending profile is oriented along the plane transverse to the hand tool axis.

It is another aspect of the present invention to provide a wire shaping system for a hand tool, wherein: the closed bending profile includes a relieved portion in the stop means.

It is another aspect of the present invention to provide a wire shaping system for a hand tool, further comprising: first tool bit members, each first member being formed with oppositely disposed tool bit ends, second tool bit members, each second member being formed with oppositely disposed tool bit ends, and a shank, the shank having a proximate end and a distal end, the shank comprising means for removably, non-rotatably, holding the shank proximate end in the handle, the shank comprises a unitary one-piece first housing having oppositely disposed open ends and two unitary one-piece second housings having oppositely disposed open ends, each of the second housings being slidably non-rotatably received in the respective opposite ends of the first housing, the first tool bit member being slidably disposed in one second housing end, and the second tool bit member being slidably disposed in the other second housing end, whereby each tool bit is alternatively operably disposed in the distal end of the shank.

It is another aspect of the present invention to provide a wire shaping system for a hand tool, wherein: the closed bending profile is oriented along the plane parallel to the hand tool axis.

It is another aspect of the present invention to provide a wire shaping system for a hand tool, further comprising: a pin element formed for releasable engagement with the at least one bending profile, and whereby a user may position the wire about the pin during the use to bend the wire along the plane transverse to the hand tool axis.

It is another aspect of the present invention to provide a wire shaping system for a hand tool, wherein: the closed bending profile includes a relieved portion in the stop means.

It is another aspect of the present invention to provide a wire shaping system for a hand tool, wherein: the closed bending profile includes: a closed bending profile along the plane transverse to the hand tool axis, and a closed bending profile along the plane parallel to the hand tool axis.

It is another aspect of the present invention to provide a wire shaping system for a hand tool, further comprising: a pin element formed for releasable engagement with one of the closed bending profiles during the use.

It is another aspect of the present invention to provide a wire shaping system for a hand tool, further comprising: first tool bit members, each first member being formed with oppositely disposed tool bit ends, second tool bit members, each second member being formed with oppositely disposed tool bit ends, and a shank, the shank having a proximate end and a distal end, the shank comprising means for removably, non-rotatably, holding the shank proximate end in the handle, the shank comprises a unitary one-piece first housing having oppositely disposed open ends and two unitary one-piece second housings having oppositely disposed open ends, each of the second housings being slidably non-rotatably received in the respective opposite ends of the first housing, the first tool bit member being slidably disposed in one second housing end, and the second tool bit member being slidably disposed in the other second housing end, whereby each tool bit is alternatively operably disposed in the distal end of the shank.

It is another aspect of the present invention to provide a wire shaping system for a hand tool, wherein: the wire shaping system is on one of a proximate end and a distal end of the hand tool handle.

It is another aspect of the present invention to provide a wire shaping system for a hand tool, wherein: a first the wire shaping system is on the proximate end of the hand tool handle, and a second the wire shaping system is on the distal end of the hand tool handle, wherein the hand tool includes two spaced wire shaping systems.

It is another aspect of the present invention to provide a wire shaping system in combination with a hand tool, the wire shaping system operable for bending a wire during a use, the system comprising: a handle on the hand tool defining a hand tool axis, the hand tool including an axially positioned and optionally removable shank in the handle, the shank having a proximate end and a distal end, the shank comprising means for removably, non-rotatably, holding the shank proximate end in the handle, the shank comprises a unitary one-piece first housing having oppositely disposed open ends and two unitary one-piece second housings having oppositely disposed open ends, each of the second housings being slidably non-rotatably received in the respective opposite ends of the first housing, a first tool bit member being slidably disposed in one second housing end, and a second tool bit member being slidably disposed in the other second housing end, whereby each the tool bit is alternatively operably disposed in the distal end of the shank, a the wire shaping system proximate the handle, the wire shaping system including at least one bending profile on an outer portion thereof for user access, the bending profile being a closed bending profile for engaging an end of a wire for bending, the bending profile oriented for engagement of the wire along one of a plane transverse to the hand tool axis and a plane parallel to the hand tool axis, and means for securing first leg portion of a wire into an engagement with the bending profile upon a rotation of the bending profile relative to the hand tool axis thereby forming a bend in the wire about the abutment, the bend being between the first leg and a second leg portion of the wire.

It is another aspect of the present invention to provide the wire shaping system in combination with a hand tool, wherein: the closed bending profile is oriented along the plane transverse to the hand tool axis.

It is another aspect of the present invention to provide the wire shaping system in combination with a hand tool, wherein: the closed bending profile is oriented along the plane parallel to the hand tool axis.

It is another aspect of the present invention to provide the wire shaping system in combination with a hand tool, further comprising: a pin element formed for releasable engagement with the at least one bending profile, and whereby a user may position the wire about the pin during the use to bend the wire along the plane transverse to the hand tool axis.

The above and other aspects, features and advantages of the present invention will become apparent from the following description read in conjunction with the accompanying drawings, in which like reference numerals designate the same elements.

BRIEF DESCRIPTION OF THE DRAWINGS

A further understanding of the present invention can be obtained by reference to a preferred embodiment set forth in the illustrations of the accompanying drawings. Although the illustrated preferred embodiment is merely exemplary of methods, structures and compositions for carrying out the present invention, both the organization and method of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present invention, reference is now made to the following drawings.

FIG. 3 is a wire shaping device in accordance with one embodiment of the present invention as noted in area 3 of FIG. 2.

FIG. 4 is a partial perspective view of a bending configuration profile from FIG. 3 shown with a wire pre-insertion in the bending configuration profile.

FIG. 11 is a wire shaping device in accordance with the embodiment of the present invention in FIG. 10, noting the enclosed multiple bending configuration profiles for differing gauges.

FIG. 12 is a sectional view along line 12-12 in FIG. 11 noting multiple enclosed bending configuration profiles according to another alternative embodiment.

FIG. 13 is a partial sectional view of FIG. 12 noting a bending and unbend motion of a wire retained in the bend profile and having a bend radius to prevent crimping and non-optimal radius formation.

FIG. 14A is a perspective illustration of a hand tool having a wire shaping system having an enclosed bending configuration arranged in an axial bending configuration in accordance with an embodiment of the present invention.

FIG. 14B is a perspective illustration of a hand tool having a wire shaping system as noted in FIG. 14A, using a pin member to allow use of the axial bending configuration profile to form a tangential bending configuration, thereby enhancing adaptation of the proposed invention.

FIG. 21 is a perspective illustration of a hand tool having a wire shaping system having an enclosed bending configuration arranged in an axial bending configuration and a radial bending configuration (combined) in accordance with an embodiment of the present invention.

FIG. 22 is a partial perspective view of a hand tool handle end having a configuration for integration with a combination wire shaping system allowing a wire shaping system to be on both a proximal and distal end of a hand tool handle.

DETAILED DESCRIPTION OF THE PREFERRED EMBODIMENTS

Figure 1:
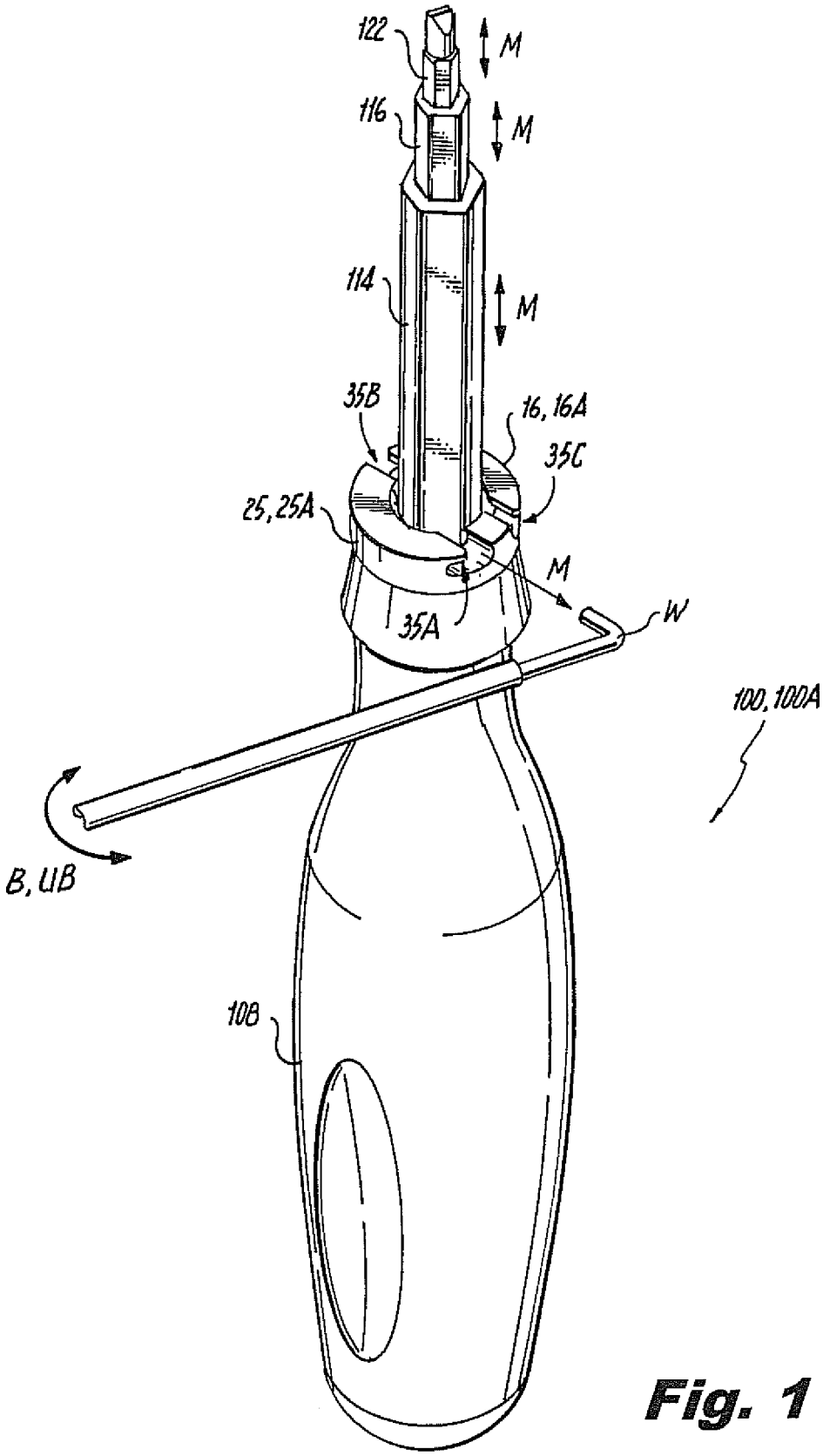
FIG. 1 is a perspective illustration of a hand tool having a wire shaping system having exposed bending configuration profiles in accordance with a first embodiment of the present invention.

As required, a detailed illustrative embodiment of the present invention is disclosed herein. However, techniques, systems, compositions and operating structures in accordance with the present invention may be embodied in a wide variety of sizes, shapes, forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present invention. Applicants hereby incorporate herein by reference thereto the entire disclosure of their U.S. Pat. No. 6,209,428, the entire disclosure of their U.S. Pat. No. 5,904,080, the entire disclosure of their U.S. Pat. No. 5,868,048, and the entire disclosure of their U.S. Pat. No. 6,286,400.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, below, etc., or motional terms, such as forward, back, sideways, transverse, etc. may be used with respect to the drawings. These and similar directional terms should not be construed to limit the scope of the invention in any manner.

It will be noted in the disclosure that there are motion arrow for motion M (insertion/removal) for a wire (W) in a bending (B) and unbending (UB) motion so as to illustrate optional and possible uses of the proposed systems. These indicators are intended to be illustrative and non-limiting to the scope and sprit of the present invention.

With reference now to the drawings and referring first generally to FIGS. 1 to 22, shown are exemplary embodiments of hand tools 100 (100A, 100B, 100C, 100D, 100E, and 100F), each with handles 108, as will be discussed, for use with this invention. A plurality of optional wire shaping systems 16 (16A, 16B, 16C, 16D and 16E) are provided each with respective outer portions 25 (25A, 25B, 25C, 25D, and 25E), as will be also discussed for use with this invention. It will be noted that outer portions 25 are shown cylindrical in shape, but are not so limited and may be any other geometry suitable for the hand tool and wire bending system without departing from the scope and spirit of the present invention (e.g., cylindrical, rectangular, octagonal, triangular, ovoidal, and any other geometry etc.). The phrase 'outer' portion is used generally, and not with restriction, but instead to identify the part of the wire shaping system 16 that is exposed for use to the user.

As will be understood, wire shaping systems 16 may allow for wire bending in a number of directions, including but not limited to generally perpendicular to an axis of the hand tool (for example FIG. 1, 14B), coaxial to an axis of the hand tool (for example FIG. 14A), a combination of both perpendicular and coaxial (for example FIG. 21 with a wire bending system 16D allowing both in combination). Additional angles may be used by merely slanting the hand tool 100, without departing from the scope and spirit of the present invention.

Figure 2:
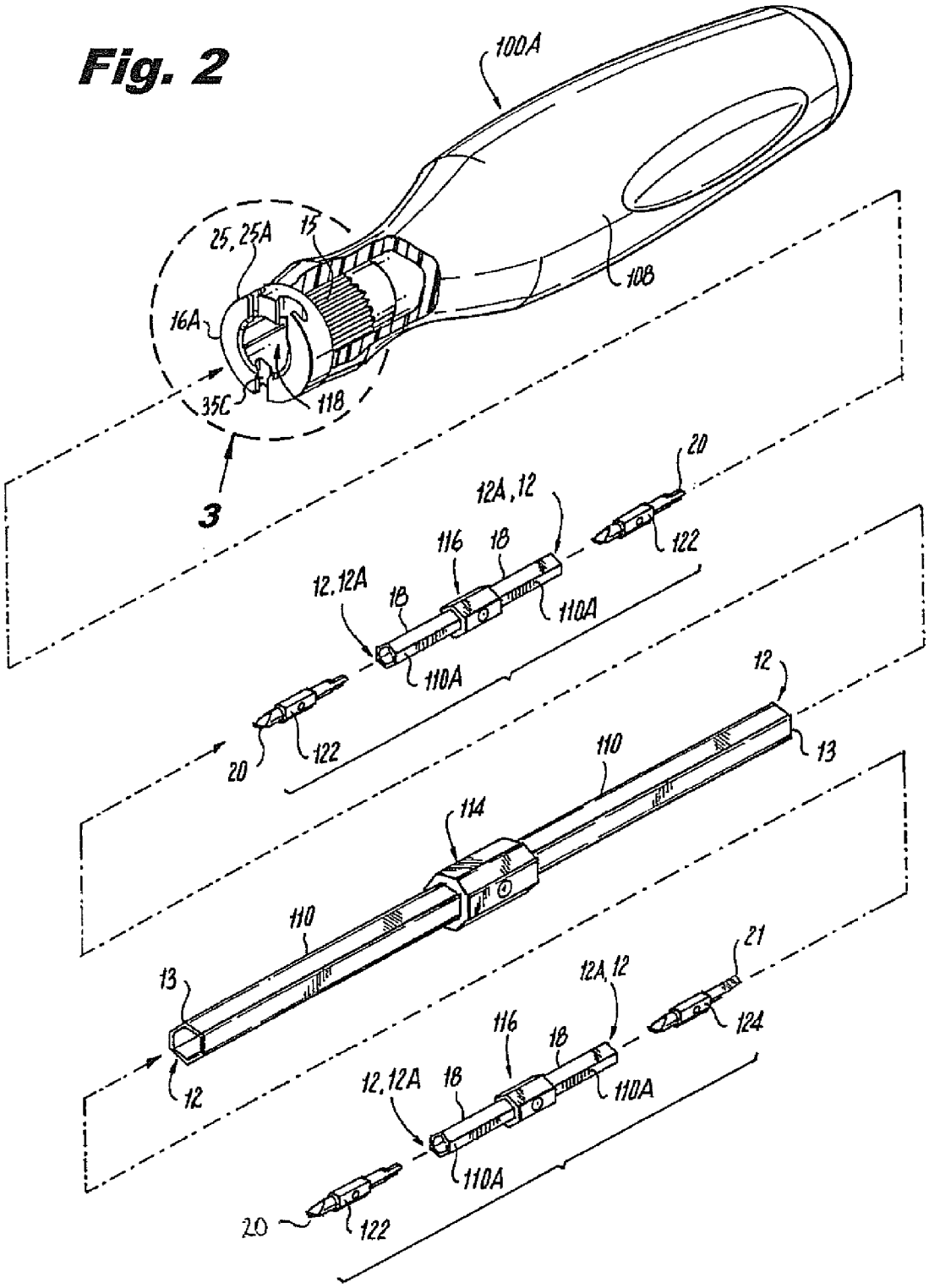
FIG. 2 is an exploded perspective view of the optional hand tool with driving members having a wire shaping device.

FIGS. 1 and 2 show a perspective and partially exploded side view of hand tool 100A having positioned therein the wire bending or shaping device 16A according to the invention having a plurality of molding ribs 15 (See FIG. 2) for secure molding into the handle, and one or more wire-bending profiles and configurations, as will be discussed.

Shown is a multi-purpose hand tool 100A having a proximate portion and a distal portion. Hand tool 100A may include a master or first housing 114 formed of drawn unitary one-piece steel construction having an integral central wall 110 and oppositely disposed hexagonal cavities 12 with hexagonal ends or end portions 13, for purposes hereinafter appearing. A pair of second housings 116, 116 is provided which have outer hexagonal surfaces 18 for slidably non-rotatably insertion into the respective hexagonal cavities 12 of first housing 114. Housings 116 are formed of drawn unitary one-piece steel construction having an integral central wall 110A and oppositely disposed hexagonal ends or end portions 12A, for purposes hereinafter appearing, each having respective further hexagonal cavities 12, as shown.

Also, optionally a plurality of four double-ended tool bits 122 may be provided having either a drive bit end 20 (flat-head, Phillips-head, star, hex, or any other type of drive bit) or a rethread bit end 124 formed at one of the oppositely disposed ends of hexagonal body tool bits 124 (typical) (see FIG. 2). Tool bit hexagonal bits 122 are sized to be slidably non-rotatably received in hexagonal cavities 12A (as shown). First housing hexagonal ends 12 and second housing hexagonal ends 12A, without the tool bits, also function as differently sized nut drivers, either by covering and driving a hex head, or by being received-in a tool having a hex-head opening. In the embodiment shown, the hand tool 100 may be a variable reach multi-bit driver hand tool. Hand tool 100 has an electrically insulated handle 108. Handle 108 has inner cavity 118 of a size and shape for removably retaining reversible coupling member 114. Inner cavity 118 is generally of a depth within handle 108 to accommodate and enclose long reach portion and short reach portions within the interior on the handle as shown.

It will be noted that a number of retention and non-rotation mechanisms may be employed without departing from the scope and spirit of the present invention. These include, but are not limited to, optionally, an anti-rotation groove 17 that can be formed for engaging a wing portion (not shown) on first housing member 114, or optionally a spring-ball detent (see FIG. 2) that may be received in a receiving region in inner cavity 118 (not shown), or the inner portion of wire shaping systems 16 may be shaped as a profile (hexagon) for receiving and retaining an outer perimeter of first housing member 114 for enabled operation after being co-formed and secured in handle 108 via molding ribs 115.

Referring first to FIGS. 1 through 9, shown is one exemplary embodiment of the wire shaping device 16A constructed in accordance with this invention. As will be described in more detail below, the wire shaping device systems 16 function as a system comprising a generally round insert having an outer portion 25A and a plurality of bending configurations and profiles or openings 35, each shown here as 35A, 35B, 35C each configured for use with a different size or gauge wire, and may be configured as a wire bending system 16 for use with any number of hand tools and handles without departing from the scope and spirit of the present invention.

As will be understood, there is shown in this embodiment an 8-in-1 or a 10-in-1, or more depending upon counting method, hand tool 100, 100A. Hand tool 100A has a proximate portion and a distal portion. Hand tool 100 includes a master or first housing 114. Generally, hand tool variable reach reversible coupling member 116 and symmetric reversible master coupling member 114 include the ability for a plurality of nested bit retaining couplings of asymmetrical or variable length bits or a combination thereof, depending upon selection of tool bits 122.

Thus, the reversible master coupling member may be of the symmetrical (having two bit sides) or asymmetrical type (having only one bit side), and the servant or inner reversible coupling member may also alternatively be of the symmetrical or asymmetrical type. In a like manner, the bits themselves or bit drivers may likewise be of symmetrical length or asymmetrical length. This allows substantial adaptation for a user.

It is appreciated that the interior of variable master bit retaining couplings 114, 116, variable or asymmetric bit retaining couplings have hexagonally (square, pentagonally, heptagonally, octagonally, etc. without limitation) shaped inner portions that serve as nut drivers as well. By varying the driver bits 122 and sizes, e.g. 3/16", 7/32", 1/4"; 9/32', 5/16" and 3/8", or metric, or other size indicators and hexagonal inner portions, hand tool 100 becomes a multi-function tool that include a minimum of ten, and additionally obviously, twelve and fourteen possible different tools in one tool.

It may be determined that optionally four rethread bits 124 of size/number of threads, viz. 6/32, 8/32, 10/32 and 10/24, with 4 correspondingly sized screw drive bits is an optimal configuration for an electrical installer. That is, that 4 rethread bits/4 screw drive bit configuration provides essentially all the practically useful electrical installation rethread and screw drive functions in a single tool. Additional or alternate screw bit drives however may be included such as shown and described in U.S. Pat. No. 5,904,080.

Turning next to FIG. 3 through 9, shown is a perspective view of the wire shaping system 16, 16A of the hand tool 100, 100A shown in FIG. 1 having a wire shaping outer portion 25A in accordance with the present invention. As more clearly shown in FIG. 2, wire shaping device 16A is preferably inserted coaxially within a first end of handle 108, but may optionally be inserted at a second end of handle 108 (See FIG. 22, discussed later). As shown, handle 108 of hand tool 100 is preferably disclosed herein as the handle of a hand tool driver, but of course handle 108 may be a handle to any number of other tools used by electrical installers. Further, handle 108 and wire shaping device 16 are generally disclosed as being generally cylindrical in shape. However, handle 108 and wire shaping device 16 may be configured in various other shapes and sizes depending on the particular use of the hand tool and will not be restricted to the shapes shown in this description.

Figure 6:
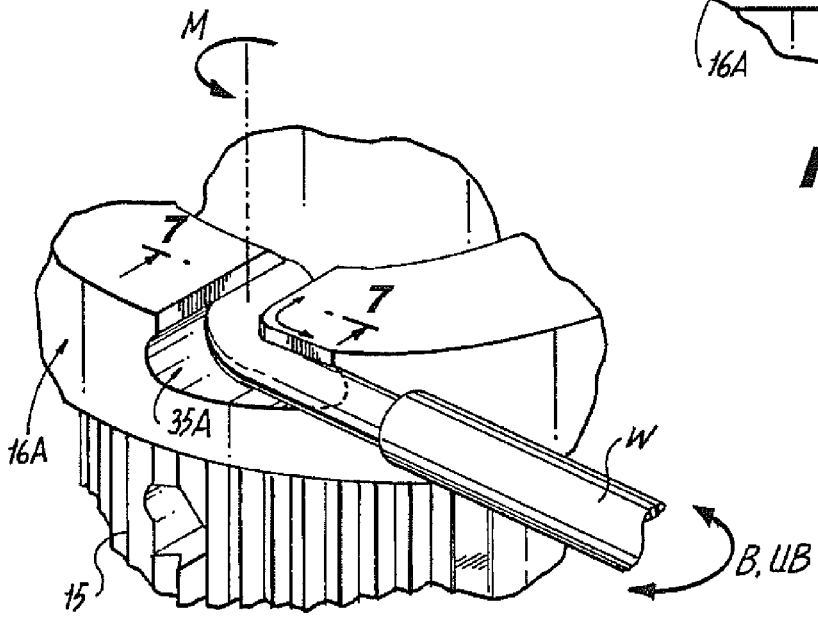
FIG. 6 is a partial perspective view like FIG. 4, with a wire inserted in the bending configuration profile in a bent condition, noting the ability to both bend and unbend in the configuration.
Figure 7:
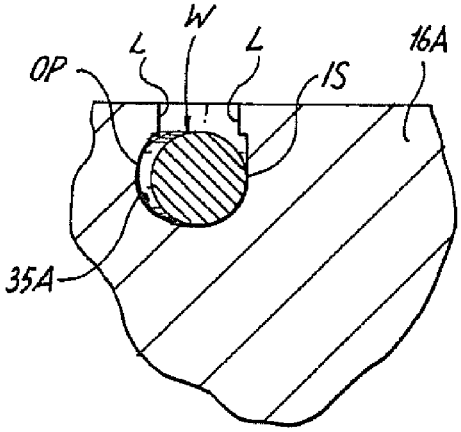
FIG. 7 is a partial sectional view through section 7-7 in the wire shaping system of FIG. 6, noting the wire cross-section retained in the bending configuration profile preventing unintended release during a bending motion.
Figure 8:
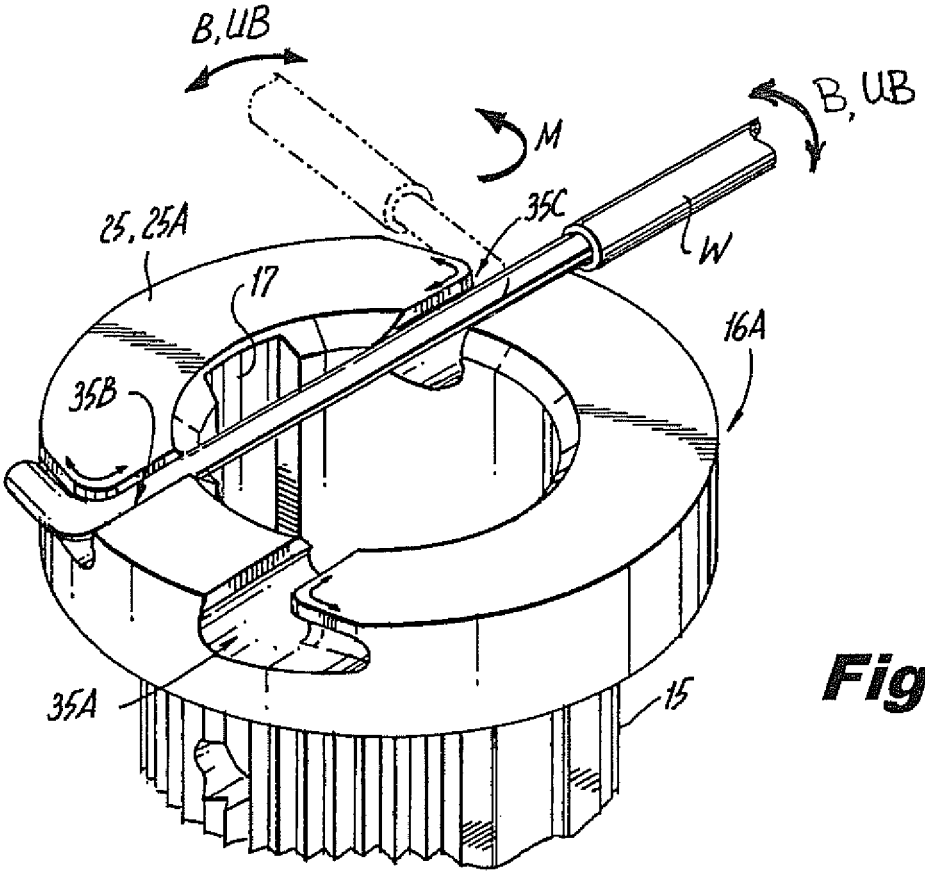
FIG. 8 is a perspective view of a wire shaping system of FIG. 3 shown with alternative wire-bending configurations, including a multiple bend and un-bend configuration.

Referring now to FIGS. 3-8, shown is the wire shaping device 10 according to the preferred embodiment of the present invention. As shown, wire shaping device 10 is generally cylindrical such that it may be inserted coaxially into the shaft of a hand tool handle 108 (FIGS. 1 & 2). Preferably, wire shaping device 10 has a lower narrower portion 6 to be inserted into the shaft of handle 108 and a wider upper portion 8 the rests adjacent to an outer end of handle 108. Upper portion 25 includes a plurality of bending configurations or profiles 35 (shown here as 35A, 35B, and 35C configured as openings in upper portion 25. As discussed in greater detail below, each bending profiles 35A-35C are specifically configured based on a desired and ideal bending radius for different size or gauge wires for electrical instillation (although other bending radii may be used without departing from the scope and spirit of the present invention). These types of profiles are called 'open profiles' as they are accessible to a viewer from two sides (a top and a side here). For example, wire shaping device 25A shown includes bending components for 10 gauge, 12 gauge, and 14 gauge wires. Further, lower portion 26 of wire shaping system 16 preferably includes ridges or other structures 15 or devices to lock or otherwise maintain wire shaping device within the shaft of handle 108 such that it remains fixed therein and cannot rotate. Optionally, lower portion 26 may be configured as a screw such that it may be engaged within a shaft of handle 108 using a screw-like motion with threads 15A engaging thread grooves 15B (See FIG. 22). When a wire W is positioned in one of the bending openings 35A-35C, the wire W may be bent or shaped to the correct shape at the appropriate radius for the type and gauge wire being used (FIG. 8).

As will be understood by one of skill in the art, it will be understood, that bending configurations 35 can be used in adaptive ways, to bend (B) on the profile or to un-bend (UB) or correct a profile—all motion being shown as (M). It will be additionally understood, that by removal of first housing 114, that multiple bends may be positioned on a single wire W (See FIG. 8 for example).

Preferably, wire shaping device 16 has a central bore 118 there through so as to allow components of the overall hand tool 100 to be positioned therein (as discussed herein). The central bore 118 may be of a cylindrical shape or of any other desired shape to secure the particular hand tool components.

Figure 9:
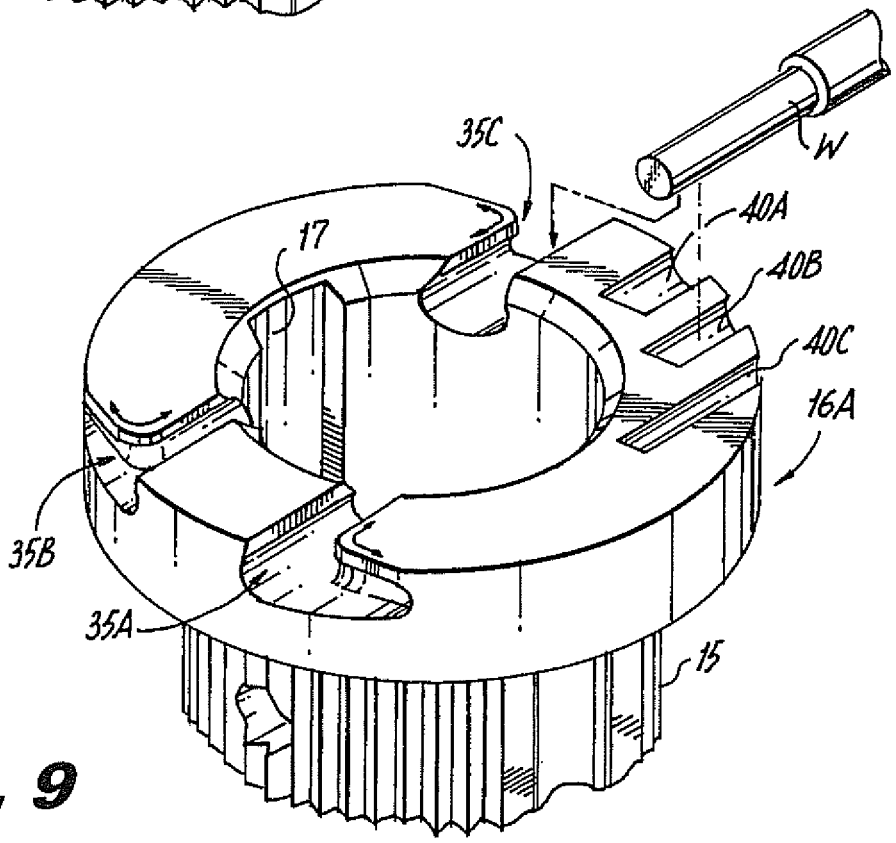
FIG. 9 is a perspective view of a wire shaping system embodiment having a wire gauging and measuring profile.
Figure 10:
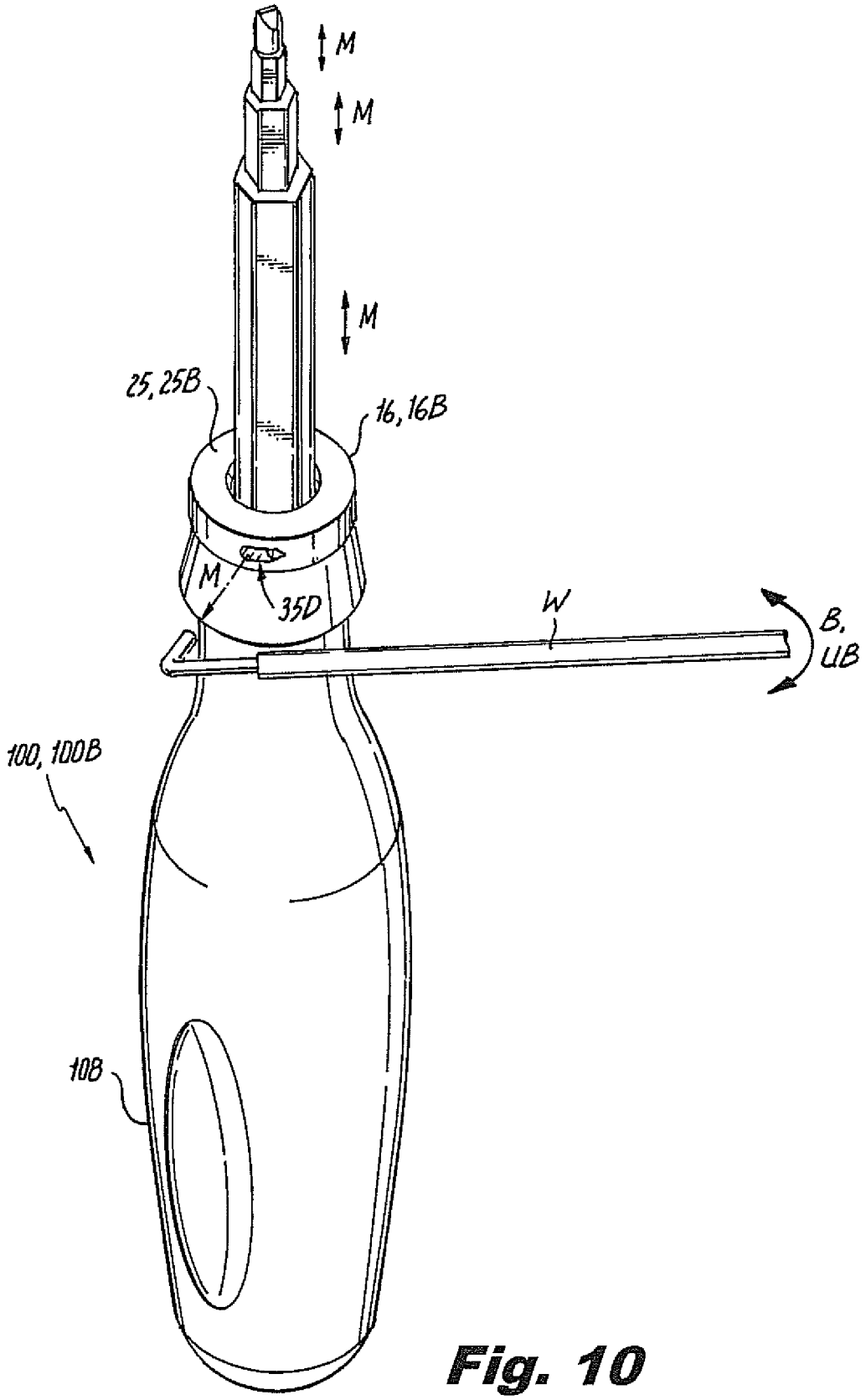
FIG. 10 is a perspective illustration of a hand tool having a wire shaping system having enclosed bending configuration profiles in accordance with an embodiment of the present invention.
Figure 15:
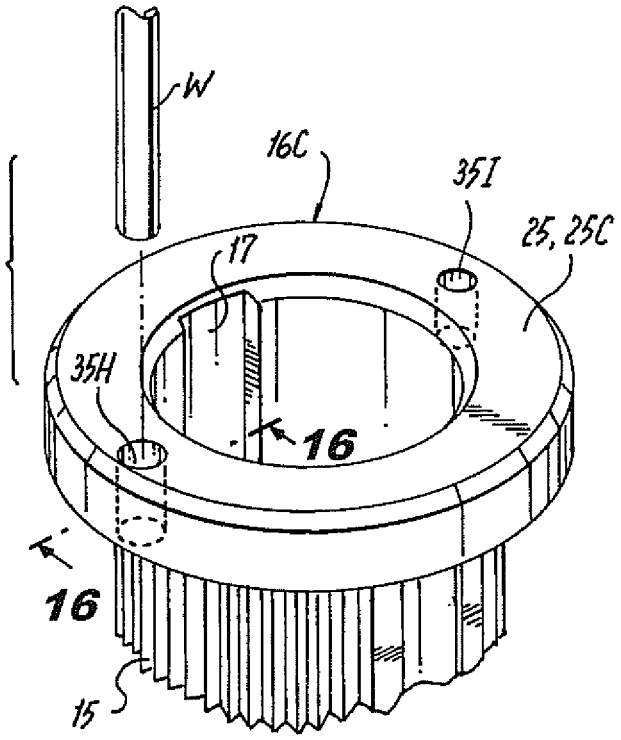
FIG. 15 is a partial perspective view of the wire shaping system of FIGS. 14A and 14B.
Figure 16:
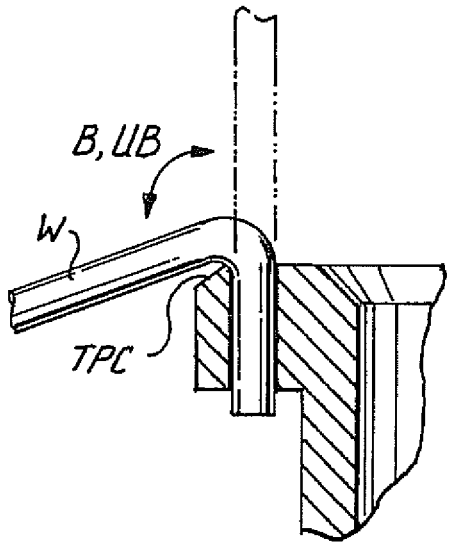
FIG. 16 is a cross-sectional view of section 16-16 in FIG. 15 noting a bending profile.
Figure 17:
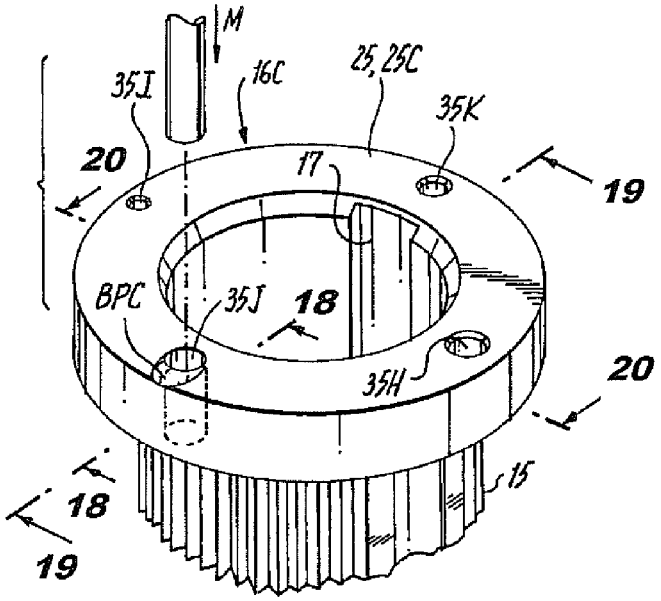
FIG. 17 is a perspective view of an alternative wire shaping system having a plurality of axial bending configurations including both full and partial depth configuration and bending radii profiles.
Figure 18:
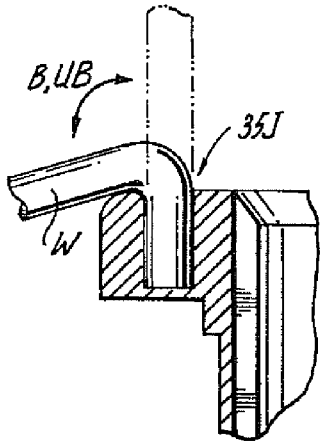
FIG. 18 is a partial cross sectional view along section 18-18 in FIG. 17, noting a support radii profile to minimizing unintended wire crimping and bending distortion.
Figure 19:
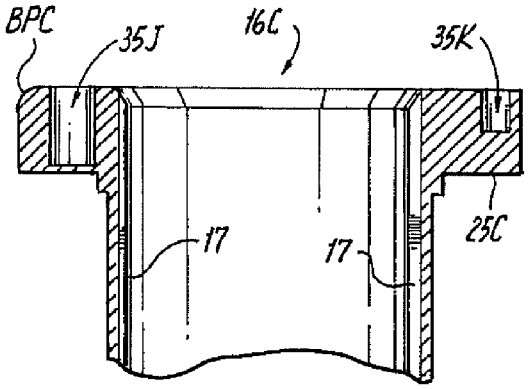
FIG. 19 is a cross sectional view along section 19-19 in FIG. 17 noting full and partial depth configuration and bending radii profiles.
Figure 20:
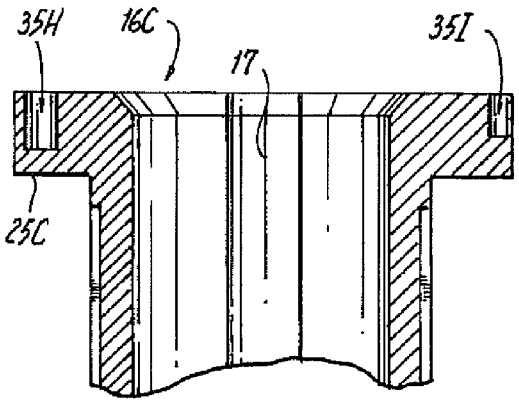
FIG. 20 is a cross sectional view along section 20-20 in FIG. 17 noting two partial depth configurations and different bending radii profiles adapted to differing gauge wires.

As shown in FIG. 9, wire shaping device 16, 16A may further include wire measuring openings 40A, 40B, and 40C to allow accurate measurement of the length of wire to be stripped of its insulating sheath to expose to bare wire. Such measurement is dependent upon the gauge of wire to be shaped or bent. For example, a 10 gauge wire need only be stripped of its sheath to a certain length 2' (for example), while a 12 gauge wire needs to be stripped to a lesser length 1.5" (for example) and a 14 gauge wire needs to be stripped to an even smaller length 1" (for example). Such measurement openings allow a user to quickly determine how much insulating sheath to remove from the end of the wire before bending it.

The cross-sectional area of each gauge is an important factor for determining its safe current-carrying capacity (based on alloy content). Increasing gauge numbers give decreasing wire diameters, which is similar to many other non-metric gauging systems. The AWG (American Wire Gauge) tables are for a single, solid, round conductor and are known to those of skill in the art. The AWG of a stranded wire is determined by the total cross-sectional area of the conductor, which determines its current-carrying capacity and electrical resistance. Because there are also small gaps between the strands, a stranded wire will always have a slightly larger overall diameter than a solid wire with the same AWG. Conventionally, the ratio of these diameters is 92, and there are 40 gauge sizes from No. 36 to No. 0000, or 39 steps. For example, a wire with an AWG of 10 has a diameter of 0.1019 inches, a wire with an AWG of 12 has a diameter of 0.0808 inches, and a wire with an AWG of 14 has a diameter of 0.0641 inches.

For each wire size and type, there is a minimum bending ratio. There are several industry standards that give minimum bending radii for many different wires. For non-limiting examples, two such sources are the National Electrical Code (NEC) and the Insulated Cable Engineers Association (ILEA). The minimum bending radius is typically 6, 8 or 12 times the diameter of the wire, depending on the size and type of wire.

Referring again to FIGS. 3-9, shown are a close up views of the shapes of the bender system openings 35 of the wire shaping system 16A and an opening bending configuration. Other bending configurations and modifications are discussed hereafter without departing from the scope and spirit of the present invention.

Figure 5:
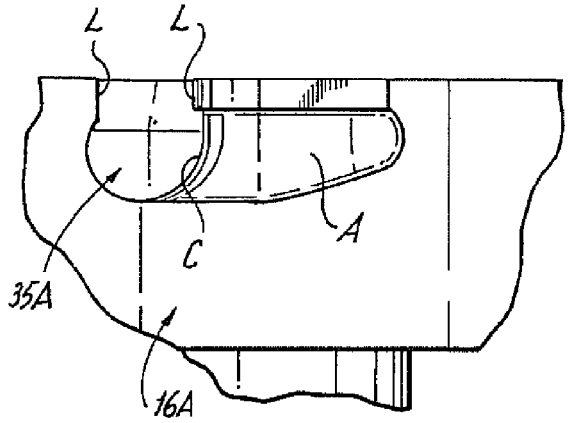
FIG. 5 is a side view of the view in FIG. 4.

As will be seen from FIGS. 5 to 7, profiles 35A-35C include a central opening that is larger than the outer diameter of the wire W for use therein, thereby providing a slightly loose fit. Opposing open lips L, L along the open channel are closer together than the outer diameter of wire W, thereby preventing upward loss of the wire W during intense bending pressure. A central curve C formed from a suitable radius matched to the designated W gauge is provided below either opposing lip L, L and joined along a continuous curve. An outer relief area A along the outer side wall of upper or outer portion 25A, functions as an abutment and allows wire W to bend at the desired radius, without crimping (a sharp bend/angle) to prevent damaging. During bending the inner tip end of stripped wire portion in profile 35A contacts the opposing (OP) side wall of profile 35A, and the proximate end of stripped wire portion in profile 35A contacts the inner side (IS) proximate the radius, whereby the tip end is trapped below lips L, L and slanted along the length of the profile 35A, as seen in FIGS. 6 and 7. In this manner, the profiles 35A-35C, known as open bending configurations, both receive and secure wires W for bending, retain the wires W during the bend (preventing pop-outs or unintended loss), and allow enough space for the post-bent wire to be readily removed by un-slanting below lips L, L. If needed, a user may use the open pending configuration to reach between lips L,L with a hand tool bit and further dislodge wire W. Thereby preventing any possible trapping of wire W in hand tool 100.

Referring now to FIGS. 10 to 13, an alternative wire bending system 16B is presented engaged with a hand tool 100B for bending a wire W in a bend (b) and unbend (UB) motion (M) during a use. Here, a plurality of bending configurations or profiles 35 are provided as enclosed configurations 35D, 35E, 35F, and 35G shown on a side outer surface of outer portion 25B allowing bending along a direction that is generally perpendicular to the axis of hand tool 100 (See FIG. 10). Also introduced are enclosed configurations 35H and 35I on a top outer surface of outer portion 25B which allow bending and unbending along a direction that is generally co-axial to the axis of hand tool 100 (these are described further in FIGS. 14A-20, below).

As can be seen best in FIGS. 11 to 13, enclosed configurations 35D-35G are shaped having an outer profile and a desired bending radius in a side curve (SC) suitable for a gauge of wire W used for the particular configuration. Similarly, each configuration is also formed with a suitable depth (D) for forming a desired length of wire gauge for a particular electrical installation configuration (e.g., sized to meet a desired code for the gauge wire (W) employed. As a result, and as can be seen best in sectional view 12, each configuration 35D-35G has a different depth (D) and a different side curve (SC) for a particular gauge of wire. As can be best appreciated in FIG. 13, an exemplary wire W is place within an enclosed configuration 35D having an outer side curve (SC) formed to create a desired radius curve as an abutment for the wire gauge and a desired depth (D) for the gauge. As will also be appreciated, the side curve (SC) is a smoothly curved radius with a relieved portion (RP), also a type of abutment, that further minimizing wire crimping and aids a the side curve (SC) in forming a smooth wire radius during a use.

Referring now to FIG. 14A, hand tool 100C is presented having wire shaping system 16C with enclosed bending configurations 35H, 35I on an upper or top surface of an outer portion 25C, as shown.

As will be appreciated in FIG. 14A, in using the bending configuration profiles 35H, 35I as noted, wire bending (B) and unbending (UB) during a motion (M) is noted as being along a co-axial direction to the long axis of hand tool 100C.

In an adaptation, noted in FIG. 14B, a hand tool 100C presented with wire shaping system 16C with enclosed bending configurations 35H, 35I on an upper or top surface of an outer portion 25C is shown here with a pin (P). Pin (P) is a rigid member sized for releasably securing in one or more of the bending configuration profiles 35H, 35I and may be separately stored (for example in handle 108). During use, a user inserts pin (P) which is a short length of rigid material in one of the profiles 35H, or 35I and ensures first housing 114 is also secured in handle 108. It will be recognized that there is a gap between pin (P) and first housing 114 which may receive an end of a wire (W) for bending, as shown in FIG. 14B. The use of a pin (P) allows easy adaption of a wire shaping system 16C that is initially suitable for a co-axial type of bending use (FIG. 14A, along the direction of the tool axis) to a type of wire shaping motion that is perpendicular to the tool axis (FIG. 14B, a similar motion to that shown in FIGS. 1 and 10). In this manner, the proposed invention may be readily used and adapted without departing from the scope and spirit of the present invention. Similarly, it will be noted that wire bending configurations 35 may be on differing orientations (e.g., a first orientation—side, and a second orientation—top) within the same invention.

Referring now in more detail to FIGS. 15 to 20 where a wire shaping system 16C is provided with several bending configuration profiles (35H, 35I in FIG. 15) and additional profiles 35J, shown with a bending profile curve (BPC) to aid non-kink bending of large gauge wires and 35K, shown as a smaller hole close to a lip side of outer portion 25C, as shown. Each bending configuration profile includes an abutment which may be shaped or not shaped or be the side of the wire shaping system 16 that limits a travel bending of a wire W during a use. For example, the outer walls of outer portion 26C form a type of abutment.

As will be noted, some wire bending configuration profiles, for example 35J, may be open bores that pass through the thickness of outer portion 25C for full engagement with a thick gauge wire. Additionally, and particularly with thick gauge wires, bending profile curves (BPCs), a type of abutment, may be provided to ensure a suitable bending curve radius according to a suitable standard. In other lighter gauges, no bending profile curve (BPC) is provided, for example in bending configuration profile 35I proximate an outer surface as an abutment—wherein a very tight radius (acute) curve may be provided during a use until contacting the outer surface. Additionally, an intentionally tight curve could be forced by the use of a tight profile curve (TPC) formation (FIG. 16) useful for a particularly difficult to bend wire, or where a set profile curve is not desired.

Referring now to FIG. 21, as noted earlier, an alternative hand tool 100E is provided with a wire shaping or bending system 16D having a two-sided outer portion 25D with two types of bending configurations and profiles 35. As noted earlier, top side or co-axial bending profiles are on a top surface of portion 25D (as were 35D-35K in FIG. 17), and side bending profiles are on a side surface portion of 25D (as were profiles 35D-35G in FIG. 12). In this manner, it will be understood that wire shaping and bending systems 16 may be readily adapted to a variety of configurations. It is also recognized (but not shown) that partially open side access configurations (see 35A-35C in FIG. 3) may be interspaced with top surface profiles 35D-35K, in FIG. 17), without departing from the scope of the present invention.

Referring additionally now to FIG. 22, where a tool member 100F is provided with an open base portion (shown) having a threaded interior groove set 15B for engaging a plurality of threads 15A on an alternative bottom positioned wire shaping system 16E, as shown, having a two sided bending configuration profile arrangement 25E (similar to the profile 25D in FIG. 21). Here, it will be noted that the bottom cap of hand tool 100F can be additionally, or alternatively, supplied with a wire shaping system 16. This alternative wire shaping system in the bottom cap may be removable (as shown), or may be fixed in place (by co-molding for example). In this way it is recognized that a bottom cap positioned wire shaping system 16, 16E (in FIG. 22) may be added to a top-position wire shaping system 16, 16A or 16B, 16C, 16D (in FIGS. 1, 10, 14A-14B, and 21) within the scope and spirit of the present invention. It will be further understood that the various surfaces of the bending configuration profiles include abutments, curves, lips, relieved portions, bending profiles etc., as shown herein, and that their description may be used adaptively without departing from the scope and spirit of the present invention, whereby during a wire bending operation a particular profile may be used during a bend to bend a wire into a desired profile until contacting the sides or abutments thereof, within the scope and spirit of the invention.

It will be further understood that the descriptors noting bending in a co-axial or perpendicular direction may be alternatively discussed as a bending along a plane that is co planer with an hand tool axis or bending along a plane that is generally transverse to the hand tool axis, all as being within the scope and spirit of the present invention as understood by those of skill in the art having studied the entire disclosure herein.

In the claims, means or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

While only a few, preferred embodiments of the invention have been described hereinabove, those of ordinary skill in the art will recognize that the embodiment may be modified and altered without departing from the central spirit and scope of the invention. Having described at least one of the preferred embodiments of the present invention with reference to the accompanying drawings, it is to be understood that such embodiments are merely exemplary and that the invention is not limited to those precise embodiments, and that various changes, modifications, and adaptations may be effected therein by one skilled in the art without departing from the scope or spirit of the invention as defined in the appended claims. Thus, the preferred embodiment described hereinabove is to be considered in all respects as illustrative and not restrictive. The scope of the invention, therefore, shall be defined solely by the following claims, rather than by the foregoing description, and all changes which come within the meaning and range of equivalency of the claims are intended to be embraced herein. Further, it will be apparent to those of skill in the art that numerous changes may be made in such details without departing from the spirit and the principles of the invention. It should be appreciated that the present invention is capable of being embodied in other forms without departing from its essential characteristics.

What is claimed is:

1. A wire shaping system for a hand tool defining a hand tool axis extending lengthwise and including a hand-gripping handle extending in a direction along the hand tool axis, the wire shaping system being proximate said handle, the wire shaping system operable for bending a wire during a use, said system comprising:

said wire shaping system including at least one bending profile on an outer portion thereof for user access;

said at least one bending profile including a channel configured to engage a distal end of a wire for bending, said channel including:

a surface defining an arc shape and including an opening, the opening extending along at least said distal portion of a length of the wire when placed therein, the surface supporting the wire, the opening being configured to receive the wire for bending and to facilitate removal of the wire from the opening, the channel further including:

a linear portion extending perpendicularly to said hand tool axis in a first direction, the linear portion including an inner dimension, the inner dimension being larger than an outer dimension said wire; and an arc-curved portion transitioning the linear portion from said first direction into a second direction generally perpendicular to said hand tool axis and also perpendicular to the linear portion along a circumference of the outer portion of said wire shaping system;

said at least one bending profile having an abutment operable for engagement of said wire along one of a plane transverse to said hand tool axis and a plane parallel to said hand tool axis, wherein upon a rotation of said bending profile relative to said hand tool axis when a wire including a first leg portion and a second leg portion is engaged with said bending profile, a bend is formed in said wire about said abutment, the bend being between said first leg portion and a second leg portion of said wire; and a stop means including a side wall spaced from said abutment for engaging said second leg portion of said wire after a predetermined amount of rotation of said bending profile relative to said hand tool axis.

2. A wire shaping system for a hand tool, according to claim 1, wherein: said closed bending profile is oriented along said plane transverse to said hand tool axis.

3. A wire shaping system, for a hand tool, according to claim 2, wherein: said closed bending profile includes a relieved portion in said stop means.

4. A wire shaping system for a hand tool, according to claim 1, wherein: said closed bending profile is oriented along said plane parallel to said hand tool axis.

5. A wire shaping system for a hand tool, according to claim 4, further comprising:

a pin element formed for releasable engagement with said at least one bending profile, and whereby a user may position said wire about said pin during said use to bend said wire along said plane transverse to said hand tool axis.

6. A wire shaping system for a hand tool, according to claim 1, wherein:

said closed bending profile includes a relieved portion in said stop means.

7. A wire shaping system for a hand tool, according to claim 1, wherein: said closed bending profile includes:

a closed bending profile along said plane transverse to said hand tool axis; and a closed bending profile along said plane parallel to said hand tool axis.

8. A wire shaping system for a hand tool, according to claim 7, further comprising: a pin element formed for releasable engagement with one of said closed bending profiles during said use.

9. A wire shaping system for a hand tool, according to claim 1, wherein:

said wire shaping system is on one of a proximate end and a distal end of said handle.

10. A wire shaping system for a hand tool, according to claim 9, wherein:

a first said wire shaping system is on said proximate end of said handle; and a second said wire shaping system is on said distal end of said handle; wherein said hand tool includes two spaced wire shaping systems.

* * * * *